US010822885B2

(12) United States Patent
Mannella

(10) Patent No.: US 10,822,885 B2
(45) Date of Patent: Nov. 3, 2020

(54) REDUCED DRAG CASING CONNECTION

(71) Applicant: GB CONNECTIONS LLC, Houston, TX (US)

(72) Inventor: Eugene J. Mannella, Richmond, TX (US)

(73) Assignee: GB Connections LLC, Houston, TX (US)

( * ) Notice: Subject to any disclaimer, the term of this patent is extended or adjusted under 35 U.S.C. 154(b) by 319 days.

(21) Appl. No.: 15/926,612

(22) Filed: Mar. 20, 2018

(65) Prior Publication Data

US 2018/0266189 A1 Sep. 20, 2018

Related U.S. Application Data

(60) Provisional application No. 62/473,870, filed on Mar. 20, 2017.

(51) Int. Cl.

| | |
|---|---|
| ***E21B 17/08*** | (2006.01) |
| ***F16L 15/00*** | (2006.01) |
| ***F16L 25/00*** | (2006.01) |
| ***F16L 35/00*** | (2006.01) |
| ***E21B 17/00*** | (2006.01) |
| ***E21B 17/02*** | (2006.01) |
| ***E21B 17/042*** | (2006.01) |

(52) U.S. Cl.

CPC ..... *E21B 17/042* (2013.01); *E21B 17/08* (2013.01)

(58) Field of Classification Search

None

See application file for complete search history.

(56) References Cited

U.S. PATENT DOCUMENTS

| | | | | |
|---|---|---|---|---|
| 3,994,516 | A | 11/1976 | Fredd | |
| 4,366,971 | A * | 1/1983 | Lula | F16L 58/182 138/109 |
| 4,445,727 | A | 5/1984 | Funk | |
| 4,508,375 | A | 4/1985 | Patterson et al. | |
| 4,522,431 | A | 6/1985 | Reimert | |
| 4,537,429 | A | 8/1985 | Landriault | |
| 4,568,113 | A | 2/1986 | Axford et al. | |
| 4,588,213 | A | 5/1986 | Bollfrass et al. | |
| 4,629,224 | A | 12/1986 | Landriault | |
| 4,753,460 | A | 6/1988 | Tung | |
| 4,770,448 | A | 9/1988 | Strickland et al. | |
| 4,892,337 | A | 1/1990 | Gunderson et al. | |
| 5,212,885 | A | 5/1993 | Buonodono et al. | |
| 5,221,113 | A | 6/1993 | Stoll | |
| RE34,467 | E | 12/1993 | Reeves | |
| 5,709,417 | A | 6/1998 | Verbeck | |
| 5,769,466 | A | 6/1998 | Noel et al. | |
| 6,698,802 | B2 | 3/2004 | Nagasaku et al. | |
| 6,764,108 | B2 | 7/2004 | Ernst et al. | |
| 6,893,057 | B2 | 5/2005 | Evans | |
| 6,991,267 | B2 | 1/2006 | Ernst et al. | |

(Continued)

*Primary Examiner* — Zachary T Dragicevich
*Assistant Examiner* — Douglas S Wood
(74) *Attorney, Agent, or Firm* — Blank Rome LLP

(57) ABSTRACT

A modified API Buttress threaded casing connection for use in oil and gas wells incorporates an integral Reduced Drag (RD) feature that comprises a tapered or rounded leading edge. In certain embodiments, both ends of the coupling incorporate the integral Reduced Drag (RD) feature that comprises a tapered or rounded leading edge to facilitate removal of the casing from a wellbore.

17 Claims, 5 Drawing Sheets

(56) References Cited

U.S. PATENT DOCUMENTS

| | | | | |
|---|---|---|---|---|
| 7,347,459 | B2 | 3/2008 | Geary et al. | |
| 7,431,347 | B2 | 10/2008 | Ernst et al. | |
| 7,549,682 | B2 * | 6/2009 | Pallini, Jr. ..... | F16L 15/004 285/390 |
| 8,075,023 | B2 | 12/2011 | Geary et al. | |
| 9,383,045 | B2 * | 7/2016 | Santi ..... | E21B 17/042 |
| 2005/0011643 | A1 | 1/2005 | Slack et al. | |

* cited by examiner

REDUCED DRAG CASING CONNECTION

CROSS REFERENCE TO RELATED APPLICATIONS

This application claims the benefit of U.S. Provisional Patent Application No. 62/473,870 filed on Mar. 20, 2017, the contents of which are hereby incorporated by reference in their entirety.

BACKGROUND OF THE INVENTION

1. Field of the Invention

The present invention relates generally to connections threaded onto casing used in oil and gas well exploration and production. More particularly, it relates to couplings used to join individual lengths of casing used in wellbores having extended laterals.

2. Description of the Related Art

After drilling an oil or gas well, it is conventional to seal off the open hole by running a string of casing pipes to the bottom of the hole and cementing the casing string in place.

Increasingly, oil and gas wells are being drilled that have extended laterals—sections of the wellbore that are substantially horizontal. This presents a challenge to running the casing string into the wellbore. Often, it is necessary to rotate the casing string while it is run into the wellbore in order to overcome friction and irregularities in the wall of the wellbore.

In conventional casing couplings, the leading edge of the coupling is substantially square (see element 53 in FIG. 1 and FIG. 2). Such a leading edge may act as a "plow" pushing increasing amounts of debris ahead of the coupling as it advances downhole. As it does, the force required to advance the casing increases, adding to the difficulty in achieving the target casing setting depth.

The present invention alleviates this problem.

BRIEF SUMMARY OF THE INVENTION

The invention comprises the following modification of threaded coupled connections:

1. The coupling is formed with an integral extension on the leading face that acts to displace material as the casing is rotated down the wellbore.
2. The coupling may be formed with integral extensions on both the leading face and the opposing face that act to displace material as the casing is rotated down the wellbore or withdrawn from the wellbore.

BRIEF DESCRIPTION OF THE SEVERAL VIEWS OF THE DRAWING(S)

FIG. 1 is a casing coupling of the prior art disclosed in U.S. Pat. No. 7,347,459.

FIG. 2 is another casing coupling of the prior art also disclosed in U.S. Pat. No. 7,347,459.

DETAILED DESCRIPTION OF THE INVENTION

Casing Couplings of the Prior Art

Figure 1:
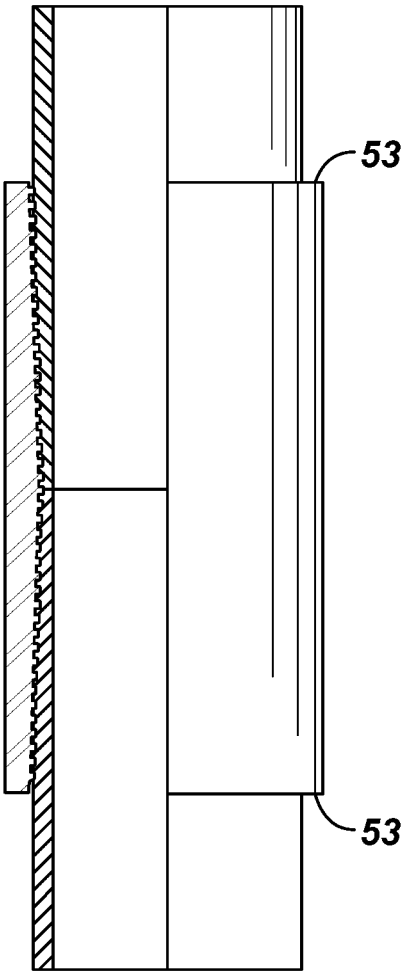
FIG. 1 (Prior Art)

Referring now to FIG. 1, a standard API Buttress Threaded casing string comprising casing sections 41 and 42 joined by coupling 45 according to the prior art is illustrated for example purposes. The casing string 10 includes two casing sections, or pipes, 41 and 42, having pin members 43 and 44 interconnected with a coupling 45 according to the prior art. FIG. 1 shows the connection fully assembled.

Still referring to FIG. 1, coupling 45 has run-out threads 66 proximate coupling ends 53. Pin end 65 is at the center of coupling 50 when the connection is fully made-up. Coupling 45 is internally threaded with coupling threads 60 which may have a single taper or different tapers in each of taper sections S1, S2, and S3. It should be noted that coupling ends 53 terminate in an essentially square face.

Figure 2:
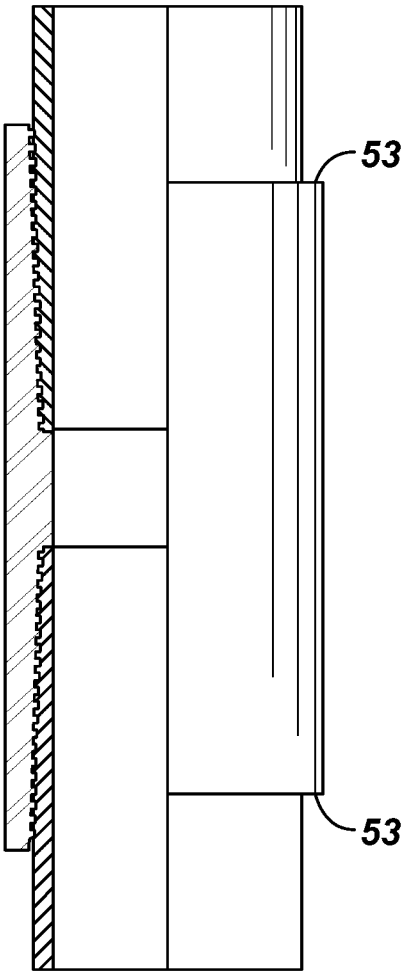
FIG. 2 (Prior Art)

The coupling illustrated in FIG. 2 is the same as the one in FIG. 1 with the exception that the "J" area between the pin ends contains an integral reinforcing cross-section 80. This heavy cross-section 80 between opposing internal square shoulders 82 substantially improves the strength of the coupling by converting the structural/mechanical behavior of the coupling from that of a simple beam to opposing cantilever beams. Both connections may use Standard API Buttress threads (or other thread forms) and are interchangeable with one another.

In conventional casing couplings, the leading edge of the coupling is substantially square (see coupling ends 53 in FIGS. 1 and 2). Such a leading edge may catch or hang-up when protrusions, steps, ledges, or other wellbore irregularities are encountered, restricting and impeding string advancement. With these occurrences, it becomes necessary to rotate and push on the casing string to assist advancement. The compound work of rotating and pushing increases the effort, difficulty, and expenses involved in achieving the target casing setting depth.

Casing Couplings According to the Present Invention

The couplings of the present invention were developed to enhance the high torque casing couplings by adding a special leading edge that reduces drag and, in at least one configuration, provides additional wear protection. This feature adds even more utility to by assisting target achievement in extended reach horizontal wells.

In the horizontal section, casing connections with square bearing faces lay along the bottom of the wellbore. As the casing string is pushed ahead, the square bearing faces gouge out the wellbore wall, collecting and pushing debris in front of each coupling. As the string advances, the amount of debris collected and pushed ahead increases. This, coupled with the tendency for square bearing faces to get hung up on any ledge or protrusion, often makes target achievement difficult and inefficient.

Oilfield operators need connections with high torque ratings for rotating casing to assist target achievement in long lateral wells. The embodiments provide this attractive utility through pin nose engagement with an opposing pin nose (FIG. 1) or an internal, integral shoulder (FIG. 2) at the center of the connections. The embodiments illustrated in FIGS. 3A, 3B, and 6-9 incorporate an integral Reduced Drag (RD) feature according to the invention.

This integral extension features a lead-in chamfer to help reduce the torque needed to advance the string by reducing drag as the casing advances. It is particularly beneficial in horizontal laterals. The connection's high torque rating and reduced-drag feature makes it significantly easier to achieve target when rotating the casing string to reduce skin friction and drag as the new feature avoids hanging up on ledges or other wellbore wall irregularities by simply riding over them.

Connections with a square bearing faces act like miniature snow plows pushing material ahead as the string advances. The further the string advances the more material that collects in front of the connection leading edge making it harder by requiring more driving forces to advance the casing string to the target setting depth.

Connections according to the present invention resist plowing inasmuch as the connections ride up and over, rather than collecting increasing amounts of material ahead of the connection leading edge that adds to the force required to advance the casing to the target setting depth.

Figure 5:
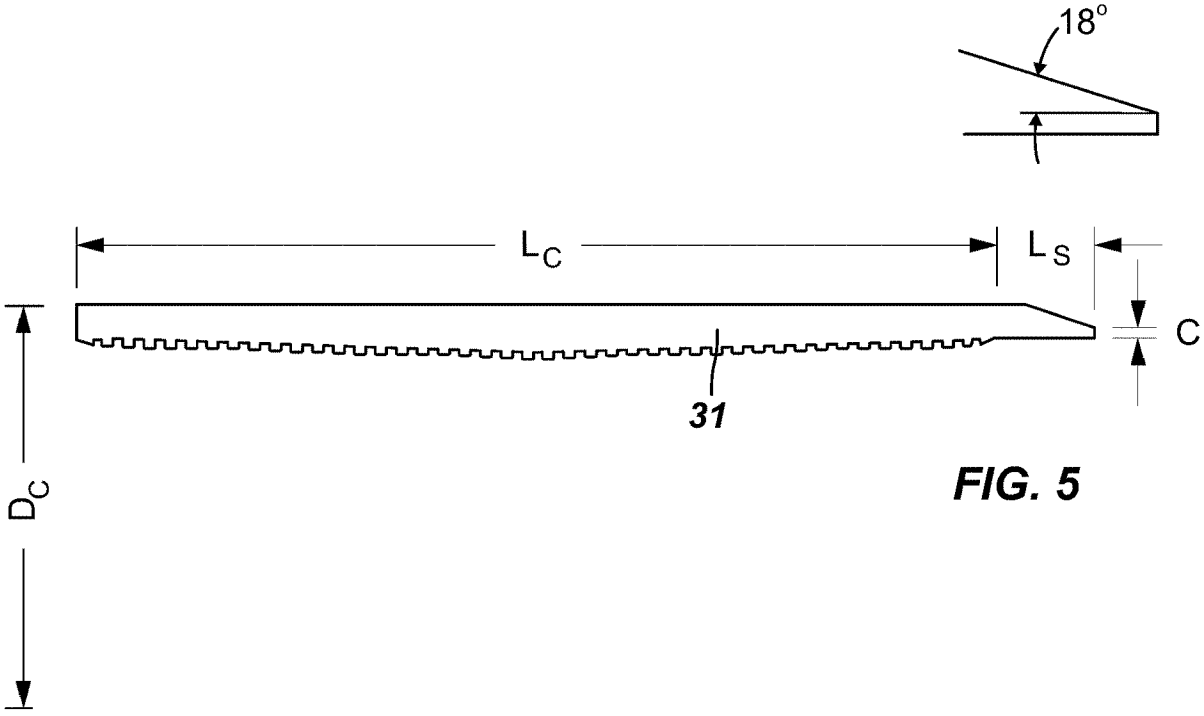
FIG. 5 shows the dimensions of certain couplings according to FIGS. 3A and 3B.
Figure 9:
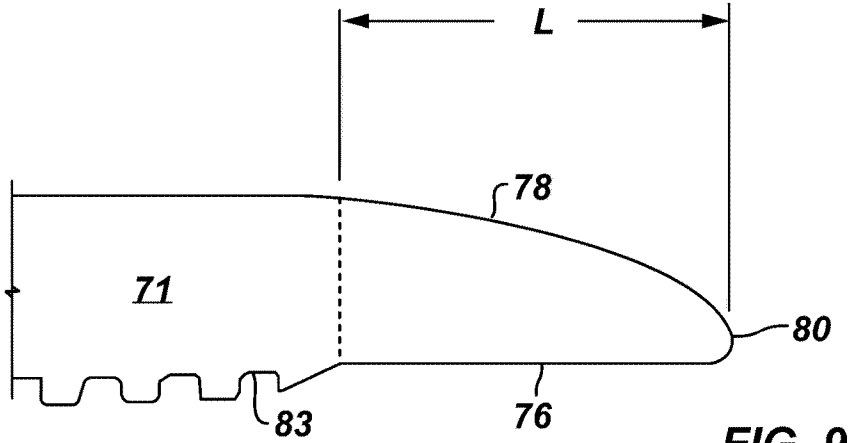
FIG. 9 is an enlarged view of a portion of the coupling illustrated in FIG. 8.

This embodiment can be machined onto any connection body that has a square bearing face (indicated by a vertical dashed line on the right side of FIGS. 3, 5, and 9).

It is not necessary that the internal diameter (I.D.) of the reduced drag feature be tapered. With the standard counterbore I.D. of typical coupling designs there is enough clearance for full tool advancement without touching the inner wall of the reduced-drag sleeve.

Design features may include the following:

- A sleeve extension for coupled connections or any tool with a square leading edge;
- A sleeve extension that may be machined from a coupling blank and is therefore integral to the coupling body;
- An external sleeve extension installed on casing toward the downhole side;
- An external sleeve extension that provides wear protection when rotating and/or advancing casing to target in deviated and horizontal oil and gas wells;
- An external sleeve extension that reduces drag, requiring less pushing force and rotating speed, when rotating and advancing casing to target in deviated and horizontal oil and gas wells;
- An external sleeve extension that avoids gouging wellbore wall when rotating and advancing casing to target in deviated and horizontal oil and gas wells;
- An external sleeve extension that avoids collecting cuttings and other wellbore debris at the leading edge when rotating and advancing casing to target in deviated and horizontal oil and gas wells; and
- An external sleeve extension that promotes riding over as opposed to catching, collecting, and pushing wellbore cuttings and debris when rotating and advancing casing to target in deviated and horizontal oil and gas wells.

The length of the sleeve extension may vary with the coupling outside diameter (O.D.), but generally may have a length of about 0 to about 1 inch.

Referring now to FIG. 5, a coupling having an 18-degree tapered leading face has a threaded portion length $L_c$, an O.D. of $D_c$ and wear sleeve of length $L_s$ each of which may vary with the diameter of the casing for which the coupling is designed.

Exemplary values of $L_c$, $D_c$ and $L_s$ (in inches) are shown in Table 1 for various casing sizes.

TABLE 1

| CASING O.D. | COUPLING O.D. $D_c$ | THREADED LENGTH $L_c$ | SLEEVE LENGTH $L_s$ |
|---|---|---|---|
| 9.625 | 10.625 | 10.000 | 1.000 |
| 8.625 | 9.625 | 10.000 | 1.000 |
| 7.625 | 8.500 | 9.625 | 1.000 |
| 7.000 | 7.875 | 9.250 | 0.875 |
| 5.500 | 6.300 | 8.500 | 0.875 |
| 5.000 | 5.800 | 8.375 | 0.875 |
| 4.500 | 5.250 | 8.125 | 0.750 |

The sleeve I.D. may have a constant diameter greater than the outside diameter of the mating pipe body and/or greater than the thread grooves of the coupling.

The sleeve face (on the extreme right side of FIG. 5) may have a nominal bearing face of 3/32".

The sleeve O.D. may have an ~18-degree tapered O.D. starting at the bearing face (extreme right side of FIG. 5) and ending at the full O.D. of the coupling body 31. In the examples illustrated in FIGS. 3B and 4B, the total length L of the sleeves is 1.000 inch and the wear sleeve portion has a length S of 0.308 inch. These dimensions may vary in other embodiments.

Figure 3A:
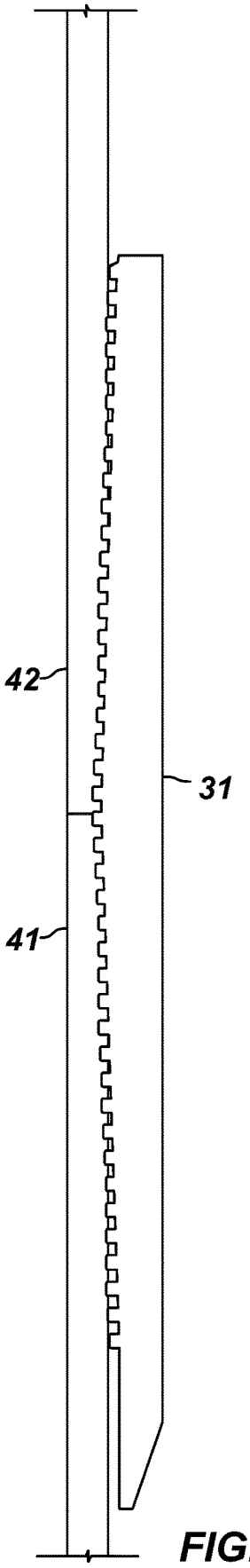
FIG. 3A is a cross-sectional side view of one side of a coupling according to a first embodiment of the invention.
Figure 3B:
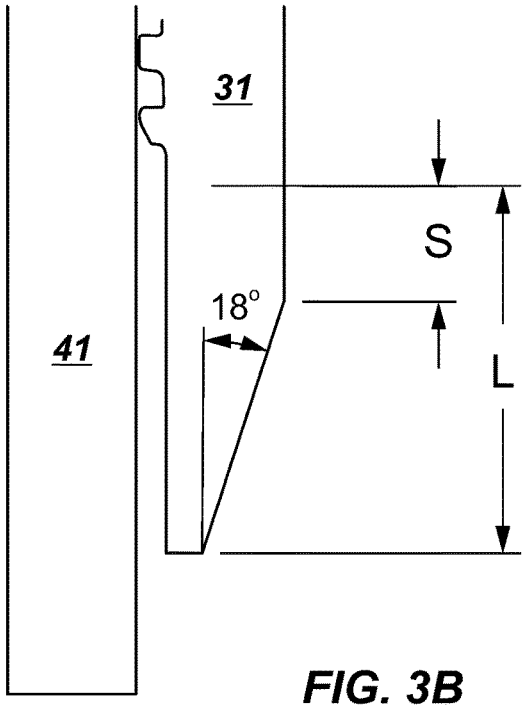
FIG. 3B is an enlargement of a portion of the coupling illustrated in FIG. 3A.

A ~1/64" fillet may be machined at the bearing face O.D. at the transition (corner) of vertical bearing face and tapered section O.D. to eliminate a sharp corner for further drag reduction (see detail in FIG. 3B).

Figure 4A:
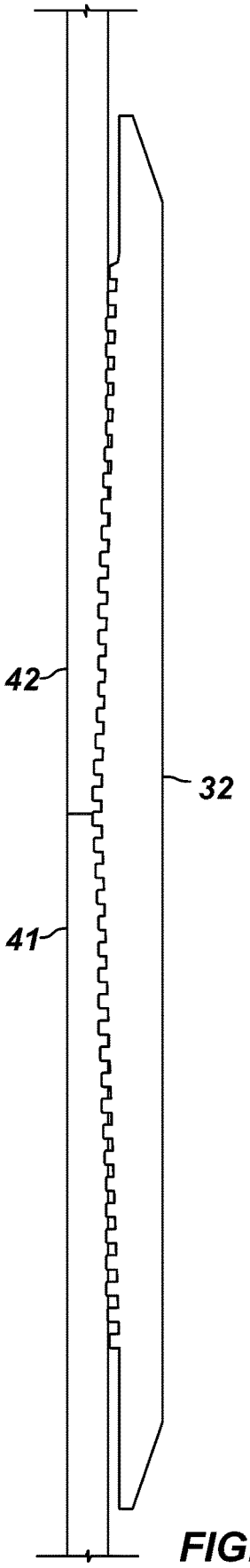
FIG. 4A is a cross-sectional side view of one side of a coupling according to a second embodiment of the invention.
Figure 4B:
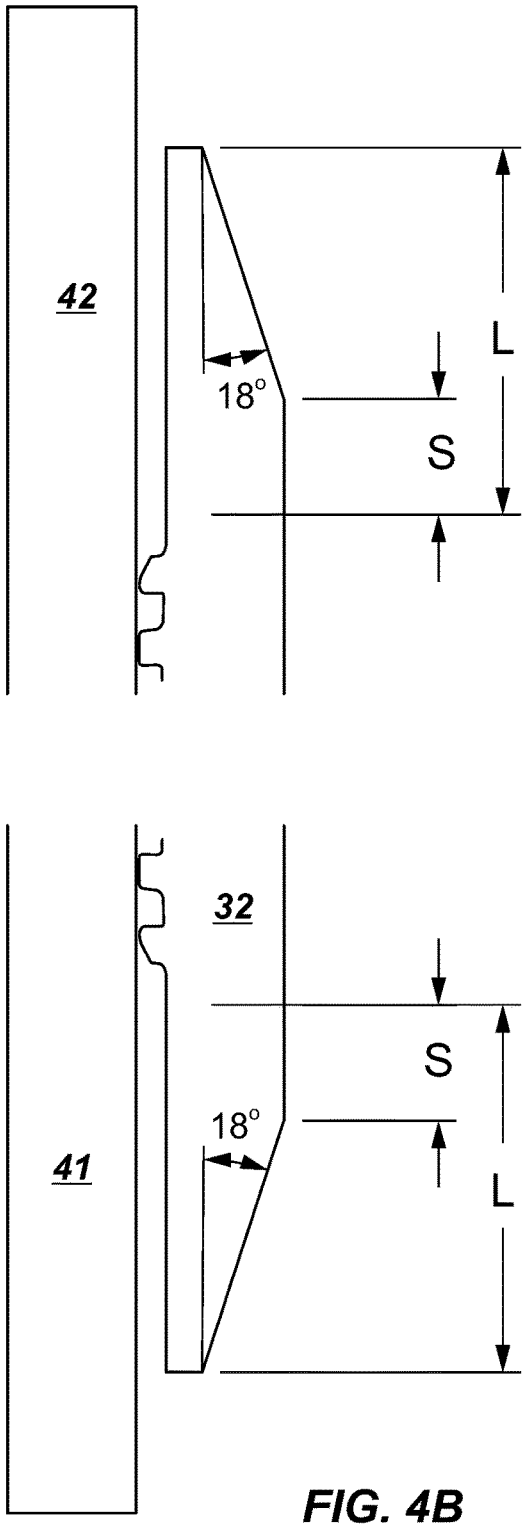
FIG. 4B is an enlargement of a portion of the coupling illustrated in FIG. 4A.

Inasmuch as it is sometime necessary to withdraw a casing string from a wellbore, it may be advantageous to provide a Reduced Drag Feature at both ends of coupling 32, as illustrated in FIGS. 4A and 4B. It should be appreciated that the Reduced Drag Feature may have the linear taper illustrated in FIGS. 4A and 4B or, alternatively, the "bullet nose configuration" consisting of a compound elliptical arc as illustrated in FIGS. 6-9. A coupling according to FIGS. 4A and 4B has the additional advantage of symmetry (which prevents inadvertent "upside down" installation).

The O.D. tapered portion of the Reduced Drag Feature may be a conical frustum (with a central, axial bore). Stated another way, the taper may be a linear taper as per the first and second embodiments illustrated in FIGS. 1-5.

Couplings equipped with a reduced drag bullet nose or a reduced drag bullet nose with integral wear sleeve according to the invention enable more efficient and effective string advancement. The bullet-nosed leading edge avoids wellbore wall gouging, debris buildup, and hang-ups on wellbore ledges and protrusions. Due to this, advancement of strings equipped with such Reduced Drag Connections require less force, allowing users to decrease rig time, reduce string deployment efforts, and decrease down-time associated with unexpected wellbore wall irregularities.

Figure 6:
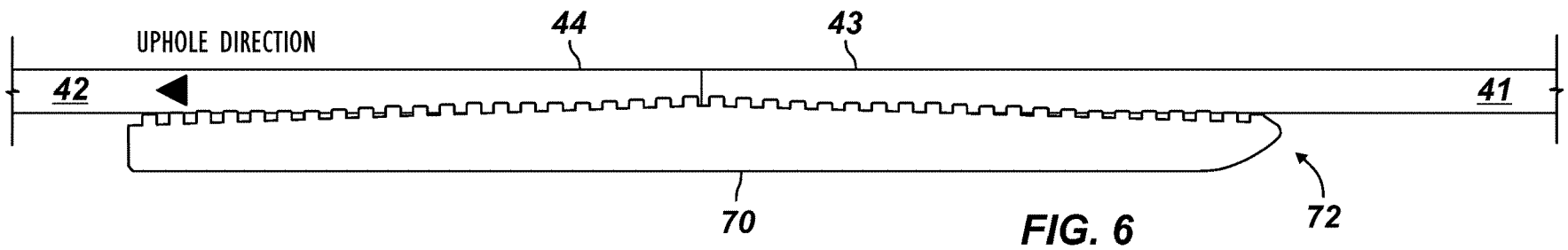
FIG. 6 is a cross-sectional side view of one side of a coupling according to a third embodiment of the invention.
Figure 7:
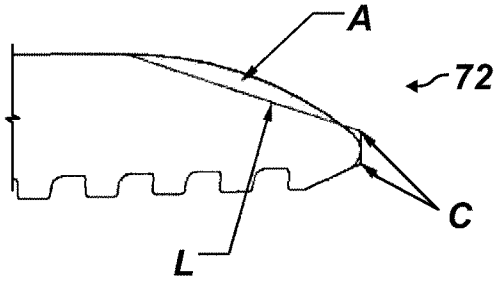
FIG. 7 is an enlarged view of a portion of the coupling illustrated in FIG. 6.

Referring now to FIG. 6, internally threaded coupling 70 is shown joining together casing sections 41 and 42 having threaded pin members 43 and 44, respectively. Coupling 70 has bullet nose 72 on its leading (i.e. downhole) end. In the enlarged view of bullet nose 72 in FIG. 7, the difference in cross-sectional shape of the bullet nose versus that of embodiments having a linear taper is shown with superimposed line L having corners C. Area A created by the bullet-nose configuration (over that of the linearly tapered version) provides additional wear material for wear resistance to protect the structural integrity of the coupling. In FIG. 7, a typical beveled bearing face is shown as line L. The rounded bearing face of the bullet nose embodiment shown in FIG. 7 is less likely to hang up on wellbore irregularities than a beveled face having sharp corners (as indicated by C in FIG. 7).

Like the embodiment shown in FIGS. 4A and 4B, a coupling may be provided with a bullet nose according to FIG. 7 on both the leading face and the opposing face that act to displace material as the casing is rotated down the wellbore or withdrawn from the wellbore.

Figure 8:
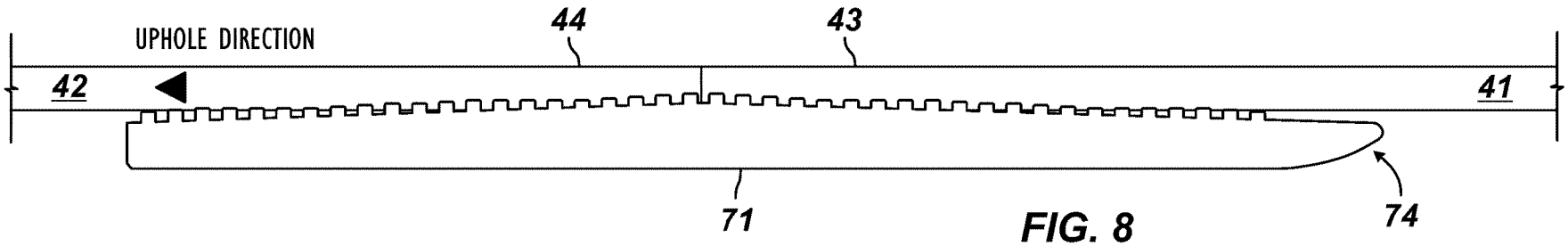
FIG. 8 is a cross-sectional side view of one side of a coupling according to a fourth embodiment of the invention.

An alternative configuration for a bullet-nosed connector is shown in FIGS. 8 and 9 wherein connector 71 (joining together casing sections 41 and 42) is equipped with an integral wear sleeve having bullet-nosed leading edge 74. As illustrated in FIG. 9, the integral wear sleeve may have a length of up to 1.000 inch and inner wall 76 may have an I.D. that is greater than the I.D. of root 83 of the run-out threads of coupling 71.

In an embodiment, outer surface 78 and nose 80 may be in the form of a compound elliptical arc.

In an embodiment, outer surface 78 may be in the form of a spherically blunted tangent ogive.

In an embodiment, outer surface 78 may be convex and have a monotonically decreasing O.D. with axial distance from the center of coupling 71.

In an embodiment, nose 80 may have a radius of curvature that is less than a radius of curvature of an adjacent portion of outer surface 78.

Advantages of connections according to the invention include the following:

- Resists gouging wellbore wall
- Will not collect and push debris ahead of connection
- Will not hang up on ledges and protrusions
- Does not compromise coupling performance properties
- Provides sacrificial wear protection or even greater wear protection with the wear sleeve-equipped version to maintain connection integrity when advancing strings through abrasive formations
- Provides high torque ratings
- API BC Compatible but can be used on any casing connection with any threadform
- High torque resistance
- Excellent make/break repeatability
- Enhanced fatigue life
- Positive makeup-to-pin-nose engagement
- Field proven in a variety of static and dynamic applications
- Saves rig time with easier string advancement It should be noted and anticipated that certain changes may be made in the present invention without departing from the overall concept described here and it is intended that all matter contained in the foregoing shall be interpreted as illustrative rather than in a limiting sense.

What is claimed is:

1. A tubular coupling for joining together two externally threaded pipe ends, the tubular coupling comprising:

a rounded edge defined distally on a downhole end of the coupling, the rounded edge being rounded from an internal diameter of the tubular coupling to an intermediate diameter, the intermediate diameter being between the inner diameter and an outer diameter of the tubular coupling; and a curved external surface defined on the downhole end proximate the rounded edge, the curved external surface monotonically increasing from the intermediate diameter of the rounded edge to the outer diameter of the tubular coupling.

2. The tubular coupling recited in claim 1 wherein the rounded edge and the curved external surface define a cross-sectional form of a bullet nose.

3. The tubular coupling recited in claim 1 wherein the rounded edge and the curved external surface define an outer wall in the form of a compound elliptical arc.

4. The tubular coupling recited in claim 1 wherein the rounded edge and the curved external surface define an outer surface in the form of a spherically blunted tangent ogive.

5. The tubular coupling recited in claim 1 wherein the rounded edge and the curved external surface define an outer surface that is convex and has a monotonically decreasing O.D. with axial distance from a center of the tubular coupling.

6. The tubular coupling recited in claim 1 wherein a distal portion of the curved external surface adjacent the rounded edge has a first radius of curvature that is less than a second radius of curvature of an adjacent portion of the curved external surface adjacent proximate an outer surface of the tubular coupling.

7. The tubular coupling recited in claim 1 further comprising:

a rounded edge on an opposing uphole end of the tubular coupling.

8. The tubular coupling recited in claim 1 wherein the externally threaded pipe ends are the ends of well casing lengths.

9. A tubular coupling for joining together two externally threaded pipe ends comprising:

a first wear sleeve on a downhole end of the tubular coupling extending beyond internal thread of the tubular coupling, the first wear sleeve having an internal diameter;

a rounded edge defined distally on a downhole distal end of the wear sleeve, the rounded edge being rounded from the internal diameter to an intermediate diameter, the intermediate diameter between the inner of the first wear sleeve and an outer diameter of the tubular coupling; and a curved external surface defined on the downhole end proximate the rounded edge, the curved external surface monotonically increasing from the intermediate diameter of the rounded edge to the outer diameter of the tubular coupling.

10. The tubular coupling recited in claim 9 wherein the rounded edge and the curved external surface define a cross-sectional form of a bullet nose.

11. The tubular coupling recited in claim 9 wherein the rounded edge and the curved external surface define an outer wall in the form of a compound elliptical arc.

12. The tubular coupling recited in claim 9 wherein the rounded edge and the curved external surface define an outer surface in the form of a spherically blunted tangent ogive.

13. The tubular coupling recited in claim 9 wherein the rounded edge and the curved external surface define an outer surface that is convex and has a monotonically decreasing O.D. with axial distance from a center of the coupling.

14. The tubular coupling recited in claim 9 wherein a distal portion of the curved external surface adjacent the rounded edge has a first radius of curvature that is less than and transitions smoothly to a second radius of curvature of an adjacent portion of the curved external surface adjacent proximate an outer surface of the tubular coupling.

15. The tubular coupling recited in claim 9 further comprising:

a second wear sleeve on an uphole end of the tubular coupling extending beyond the internal thread, the second wear sleeve having the internal diameter;

a rounded edge defined distally on an uphole distal end of the second wear sleeve.

16. The tubular coupling recited in claim 9 wherein the externally threaded pipe ends are the ends of well casing lengths.

17. The tubular coupling recited in claim 9 wherein at least a portion of the internal diameter of the first wear sleeve has a constant inside diameter that is greater than that of run-out threads of the internal threads on the tubular coupling.

* * * * *